US009689198B2

(12) United States Patent
Maeda

(10) Patent No.: US 9,689,198 B2
(45) Date of Patent: Jun. 27, 2017

(54) WINDOW CONDUCTION HEAT SHIELDING APPARATUS

(71) Applicant: Hitachi Systems, Ltd., Shinagawa-ku, Tokyo (JP)

(72) Inventor: Takahiro Maeda, Tokyo (JP)

(73) Assignee: Hitachi Systems, Ltd., Shinagawa-ku, Tokyo (JP)

( * ) Notice: Subject to any disclaimer, the term of this patent is extended or adjusted under 35 U.S.C. 154(b) by 202 days.

(21) Appl. No.: 14/651,293

(22) PCT Filed: Dec. 13, 2012

(86) PCT No.: PCT/JP2012/082343
§ 371 (c)(1),
(2) Date: Jun. 11, 2015

(87) PCT Pub. No.: WO2014/091595
PCT Pub. Date: Jun. 19, 2014

(65) Prior Publication Data

US 2015/0330141 A1 Nov. 19, 2015

(51) Int. Cl.
*F24D 19/02* (2006.01)
*E06B 9/06* (2006.01)
*E06B 3/28* (2006.01)

(52) U.S. Cl.
CPC ..... *E06B 9/0676* (2013.01); *E06B 9/0638* (2013.01); *E06B 3/28* (2013.01)

(58) Field of Classification Search
CPC ..... E06B 9/0676; E06B 9/0638; E06B 3/28; E06B 3/24; E06B 3/64
(Continued)

(56) References Cited

U.S. PATENT DOCUMENTS 4,483,099 A * 11/1984 Schmidt ..... E06B 3/4618 49/504
4,598,520 A * 7/1986 Ellstrom ..... E06B 3/685 52/314
(Continued)

FOREIGN PATENT DOCUMENTS

JP H8-74477 A 3/1996
JP 2003-121060 A 4/2003
JP 2010-265622 A 11/2010

OTHER PUBLICATIONS

International Search Report for PCT Application PCT/JP2012/082343 dated Feb. 18, 2013.

*Primary Examiner* — Davis Hwu
(74) *Attorney, Agent, or Firm* — McCormick, Paulding & Huber LLP

(57) ABSTRACT

A window conduction heat shielding apparatus capable of shielding heat conducted from the outdoors in the summer season and efficiently conducting heat to the outdoors in the winter season in a window of a computer room, thereby reducing a load of air conditioning is provided. A window conduction heat shielding apparatus 7 that shields heat conducted from an outdoor surface to an indoor surface of a window 3 of a computer room 1 includes: a heat shielding unit 17 that has a heat insulating material 8 formed according to a size of the window 3 and a fixing base 9 provided on an indoor surface of the heat insulating material 8; support bars 10*a* and 10*b* provided in both side parts of the fixing base 9; and base guides 16 that are provided in both side parts of a window frame 5 and have guide grooves 12 to 15 to guide the heat shielding unit 17 via the support bar 10*a* and 10*b* from a storage part 11 below the window to the indoor surface of the window 3 or from the indoor surface of the window 3 to the storage part 11.

5 Claims, 7 Drawing Sheets

(58) Field of Classification Search
USPC ..... 165/53
See application file for complete search history.

(56) References Cited

U.S. PATENT DOCUMENTS 4,989,384 A * 2/1991 Kinghorn ..... E06B 3/6604 52/171.3
6,425,221 B1 * 7/2002 Reichert ..... E06B 3/6604 428/71

* cited by examiner (a)

(b)

WINDOW CONDUCTION HEAT SHIELDING APPARATUS

CROSS REFERENCE TO RELATED APPLICATIONS

This application is entitled to the benefit of and incorporates by reference subject matter disclosed in International Patent Application No. PCT/JP2012/082343 filed on Dec. 13, 2012.

TECHNICAL FIELD

The present invention relates to a window conduction heat shielding apparatus, and in particular relates to a technique to shield heat conducted from the outdoors through a window of a computer room in the summer season and to efficiently conduct the heat from the indoors to the outdoors in the winter season.

BACKGROUND ART

Usually, when a computer room of a data center or the like has a window, the computer room is likely to receive an influence of conduction heat from the outdoors in the summer season. Therefore, for the purpose of suppressing an influence of conduction heat from the outdoors in the summer season, for example, countermeasures of providing a shading curtain 51 on an indoor side of a window 3 as illustrated in FIG. 7, attaching a light shielding film on a window glass Japanese Patent Application Laid-Open Publication No. 2010-265622 and providing a double window have been taken.

SUMMARY

However, even though the countermeasure by the shading curtain can acquire an effect of light shielding and is thus widely used, it still has a problem that conduction heat 52 enters the indoors through a gap between the shading curtain 51 and the window 3.

On the other hand, in the countermeasure by the light shielding film, there exist restrictions on use, namely, there is a possibility that a window glass may be damaged when the window glass is a wire glass.

Also, the countermeasure by the double window has a problem of high installation cost. Therefore, none of those are fundamental countermeasures.

Conversely, in the winter season, there is a request to reduce a load of air conditioning by conducting heat of the indoors to the outdoors, but the conventional techniques mentioned above have difficulty meeting even such a request.

Thus, the present invention has been made in order to solve the problems mentioned above, and an object thereof is to provide a window conduction heat shielding apparatus capable of shielding heat conducted from the outdoors in the summer season and efficiently conducting heat in the indoors to the outdoors in the winter season in a window of a computer room, thereby reducing the load of air conditioning.

The invention is a window conduction heat shielding apparatus that shields heat conducted from an outdoor surface to an indoor surface of a window of a computer room, and the apparatus includes: a heat shielding unit that has a heat insulating material formed according to a size of the window and a fixing base provided on an indoor surface of the heat insulating material; support bars provided in both side parts of the fixing base; and base guides that are provided in both side parts of the window and have guide grooves to guide the heat shielding unit via the support bars from a storage part below the window to the indoor surface of the window or from the indoor surface of the window to the storage part.

The invention is characterized in that the base guide has an adjustment mechanism to adjust a moving speed when the heat insulating material is moved from the indoor surface of the window to the storage part via the support bars along the guide grooves.

The invention is characterized in that the heat shielding unit is stored in the storage part while maintaining a posture in which the heat shielding unit is attached to the indoor surface of the window.

The invention is characterized in that the heat shielding unit is divided into a plurality of sections according to a height of the storage part.

The invention is characterized in that the adjustment mechanism includes a movement mechanism to move the heat shielding unit from the storage part to the indoor surface of the window or from the indoor surface of the window to the storage part and a control unit to control a moving direction and a moving speed of the movement mechanism.

According to the present invention, it is possible to provide a window conduction heat shielding apparatus capable of shielding heat conducted from the outdoors in the summer season and efficiently conducting heat in the indoors to the outdoors in the winter season in a window of a computer room, thereby reducing the load of air conditioning.

BRIEF DESCRIPTIONS OF THE DRAWINGS

DETAILED DESCRIPTION

Hereafter, an embodiment of the present invention will be described in detail with reference to FIGS. 1 to 6.

Figure 1:
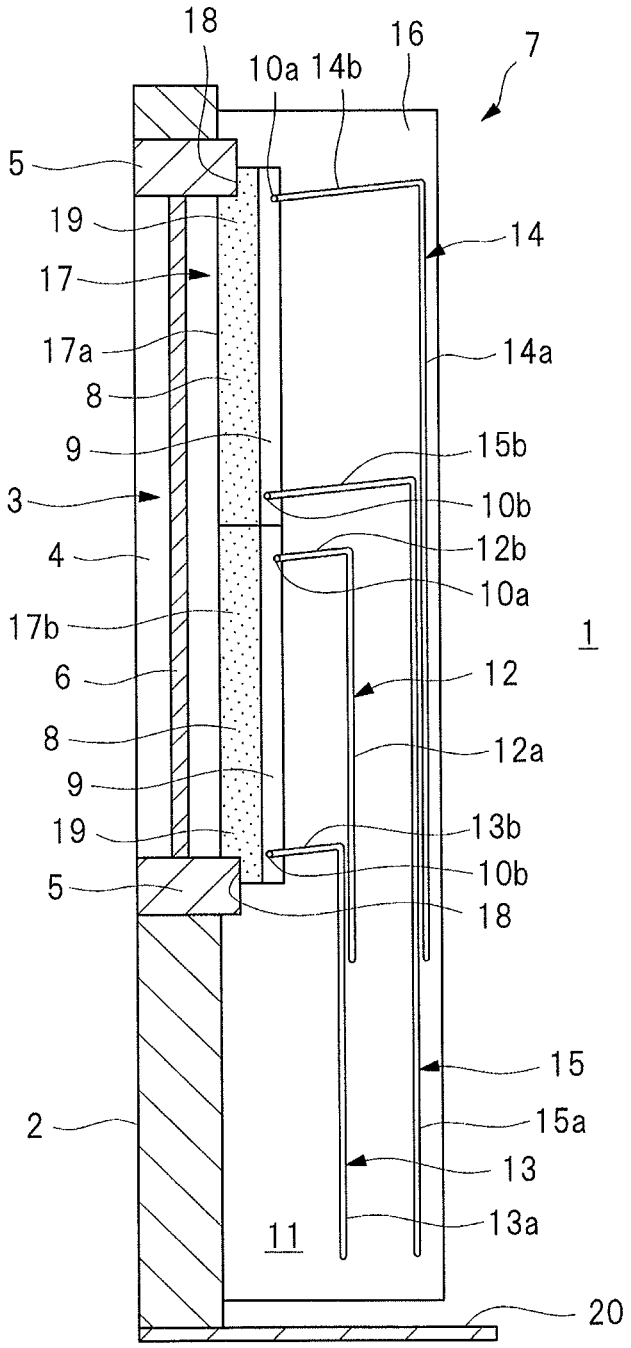
FIG. 1 is a longitudinal sectional view illustrating a shielded state in an embodiment of a window conduction heat shielding apparatus according to the present invention.
Figure 2:
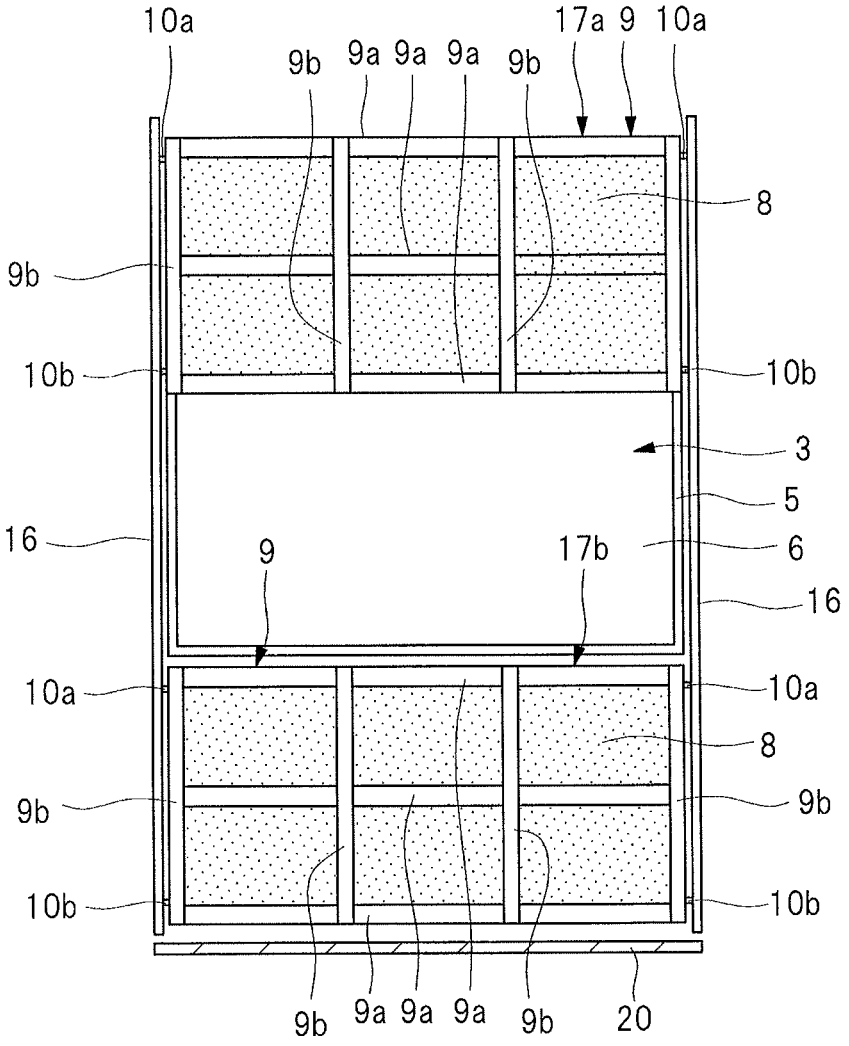
FIG. 2 is an explanatory diagram for describing an attaching process of an upper heat shielding unit and a lower heat shielding unit of the window conduction heat shielding apparatus.

In FIGS. 1 and 2, a reference character 1 denotes a computer room of a data center or the like, and a window 3 is provided in a wall 2 of a building that forms this computer room 1. The window 3 is mainly made up of an opening part 4 formed in the wall 2, a window frame 5 provided in the opening part 4 and a window glass 6 attached in the window frame 5.

Then, for shielding heat conducted from an outdoor surface to an indoor surface of the window glass 6 of the window 3, a window conduction heat shielding apparatus 7 is provided for the window 3. This window conduction heat shielding apparatus 7 is provided with: a heat shielding unit 17 having a heat insulating material 8 formed according to a size of the window 3 and a fixing base 9 provided on an indoor surface of the heat insulating material 8; a pair of upper and lower support bars 10*a* and 10*b* each provided in both side parts of the fixing base 9; and a pair of right and left base guides 16 that are provided in both side parts of the window 3 and have guide grooves 12 to 15 to guide the heat shielding unit 17 via the support bars 10*a* and 10*b* to the window 3 from a storage part (also referred to as a housing part or a housing position) 11 underneath window, that is, below the window 3 or to the storage part 11 from the window 3.

The heat shielding unit 17 is divided into a plurality of sections (divided into two sections in the illustrated example) in a vertical direction according to a height from a floor 20 so as to be stored in the storage part 11 below the window. More specifically, in the case of the embodiment, the heat shielding unit 17 is divided into an upper heat shielding unit 17*a* and a lower heat shielding unit 17*b*.

Since each of the upper heat shielding unit 17*a* and the lower heat shielding unit 17*b* has a vertically symmetrical shape, one of them, for example, the upper heat shielding unit 17*a* will be described. As illustrated in (a) and (b) of FIG. 3, the upper heat shielding unit 17*a* is made up of the heat insulating material 8 and the fixing base 9. Although the heat insulating material 8 and the fixing base 9 are different in thickness, they are formed into a quadrangular shape having substantially the same size when viewed from the front. In order to facilitate the operation at the time of moving the upper heat shielding unit 17*a* from the storage part 11 to the window frame 5 or from the window frame 5 to the storage part 11, a pair of upper and lower support bars 10*a* and 10*b* are provided in a state of horizontally projecting in both of right and left side parts of the fixing base 9.

The heat insulating material 8 is made of, for example, styrene foam. The fixing base 9 is formed by framing a plurality of horizontal frames 9*a* (3 frames in the illustrated example) and a plurality of vertical frames 9*b* (4 frames in the illustrated example). The horizontal frame 9*a* and the vertical frame 9*b* are made from a frame material having rigidity. The frame material is preferably made of, for example, metal, wood or plastic. The heat insulating material 8 is adhered to an outer surface part of the heat insulating material fixing base 9 by fixing means such as an adhesive.

As illustrated in FIG. 1, the upper heat shielding unit 17*a* and the lower heat shielding unit 17*b* are pressed to seal the window 3. In this case, for the purpose of preventing a displacement between the window frame 5 and the upper heat shielding unit 17*a* and lower heat shielding unit 17*b*, a recess part 18 for being engaged so as to bite into the window frame 5 is formed in a peripheral edge part of the heat insulating material 8 of the upper heat shielding unit 17*a* and the lower heat shielding unit 17*b* so that the heat insulating material 8 may bite into (be engaged with) the window frame 5. Specifically, the recess part 18 is formed in the upper part and right and left side parts of the heat insulating material 8 of the upper heat shielding unit 17*a*, and the recess part 18 is formed in the lower part and right and left side parts of the heat insulating material 8 of the lower heat shielding unit 17*b*. Thus, in the upper heat shielding unit 17*a* and the lower heat shielding unit 17*b*, a projecting part 19 fitted to the inside of the window frame 5 is formed.

Figure 5:
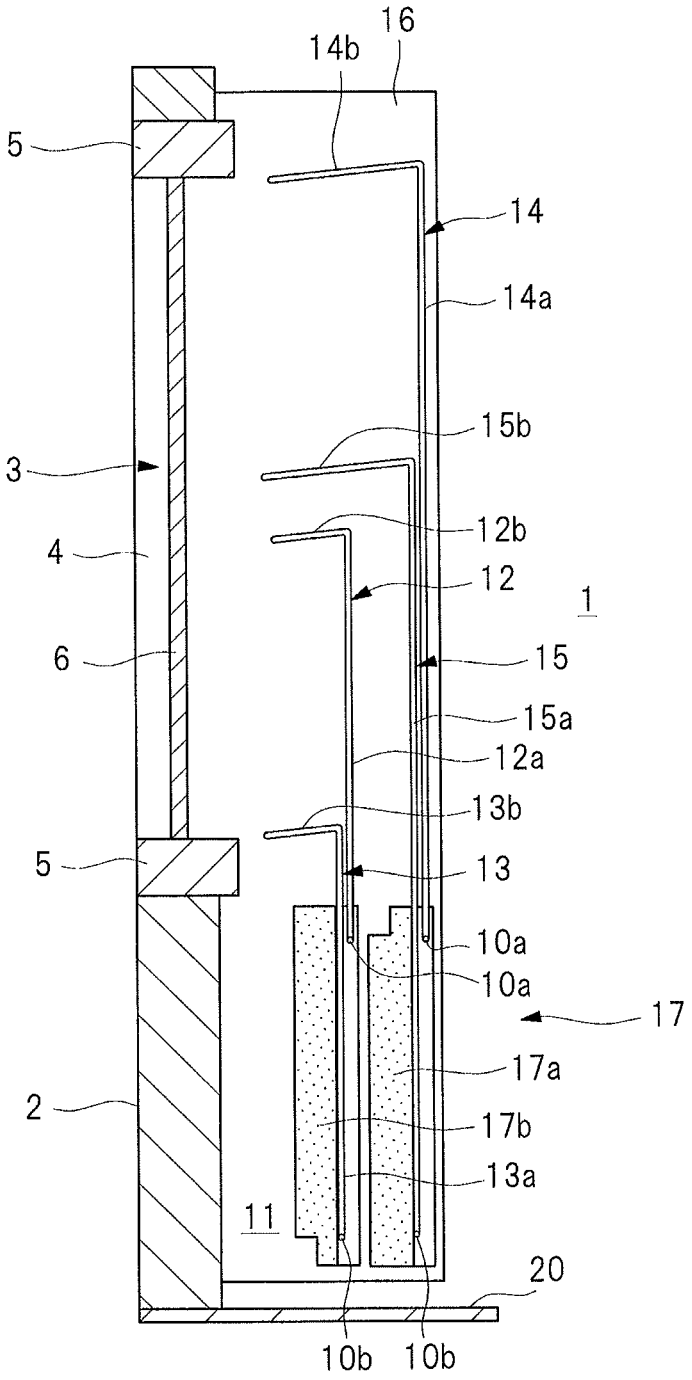
FIG. 5 is a sectional view illustrating a state where the heat insulation shielding member of the window conduction heat shielding apparatus is made to descend to a storage space along vertical guide grooves.

A space above the floor 20 below the window 3 (also referred to as underneath window) in the computer room 1 is used as the storage part (storage space) 11 of the heat shielding unit as illustrated in FIG. 5. The upper heat shielding unit 17*a* and the lower heat shielding unit 17*b* are stored in a state of being stacked back and front in the thickness direction in the storage part 11 below the window, and space-saving of the storage part 11 has been achieved. In this case, the lower heat shielding unit 17*b* is disposed near the wall 2 below the window, and the upper heat shielding unit 17*a* is disposed in a state of being stacked in proximity behind the lower heat shielding unit 17*b*.

In addition, as illustrated in FIG. 5, the upper heat shielding unit 17*a* and the lower heat shielding unit 17*b* are supported by the lower ends of the guide grooves 12 to 15 via the support bars 10*a* and 10*b*, and are supported (suspended) in a state of floating from the floor 20. Since the upper heat shielding unit 17*a* and the lower heat shielding unit 17*b* are not directly placed on the surface of the floor 20, the surface of the floor 20 can be cleaned easily, and the inside of the computer room 1 can be maintained in a clean environment. Note that, since the upper heat shielding unit 17*a* and the lower heat shielding unit 17*b* are supported in a state of floating from the floor 20, a support base and a cushion material may be placed on the floor 20 for the purpose of preventing them from swinging due to a vibration and the like. Alternatively, the upper heat shielding unit 17*a* and the lower heat shielding unit 17*b* may be placed on the floor 20.

The support bars 10*a* and 10*b* are made up of a shaft having a cylindrical shape or a pipe shape, and the protrusion length thereof is 2 to 3 cm. For example, a material of the support bars 10*a* and 10*b* is preferably metal, plastic or the like. For the purpose of smoothly moving the support bars 10*a* and 10*b*, a wheel or a roller may be attached to the support bars 10*a* and 10*b*.

Figure 3:
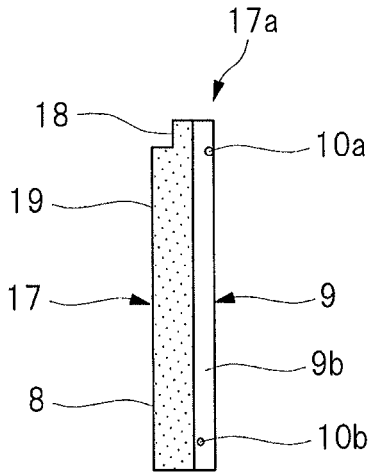
FIG. 3 illustrates the upper heat shielding unit, and (a) is a left side view and (b) is a rear view.
Figure 3:
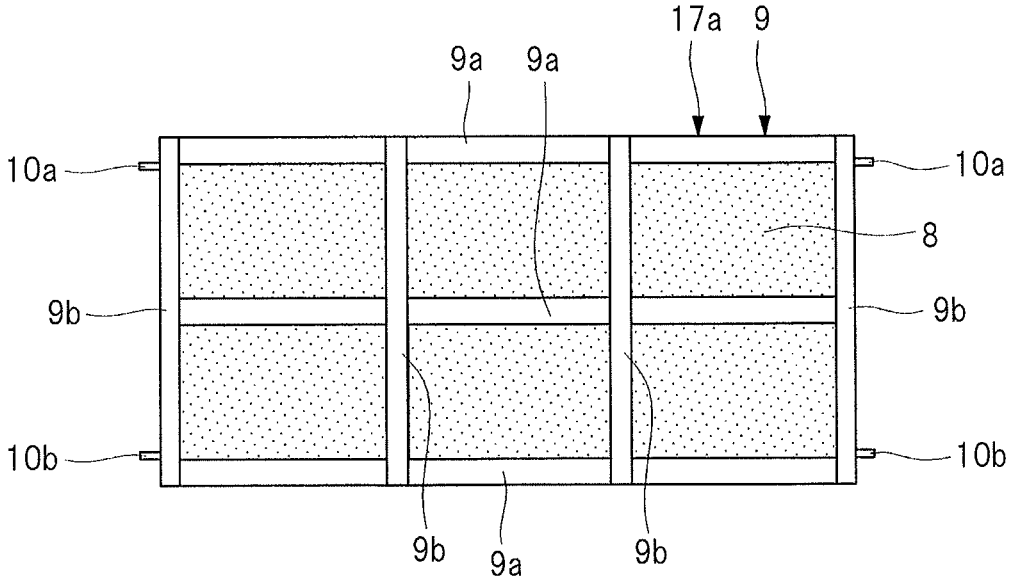
Figure 4:
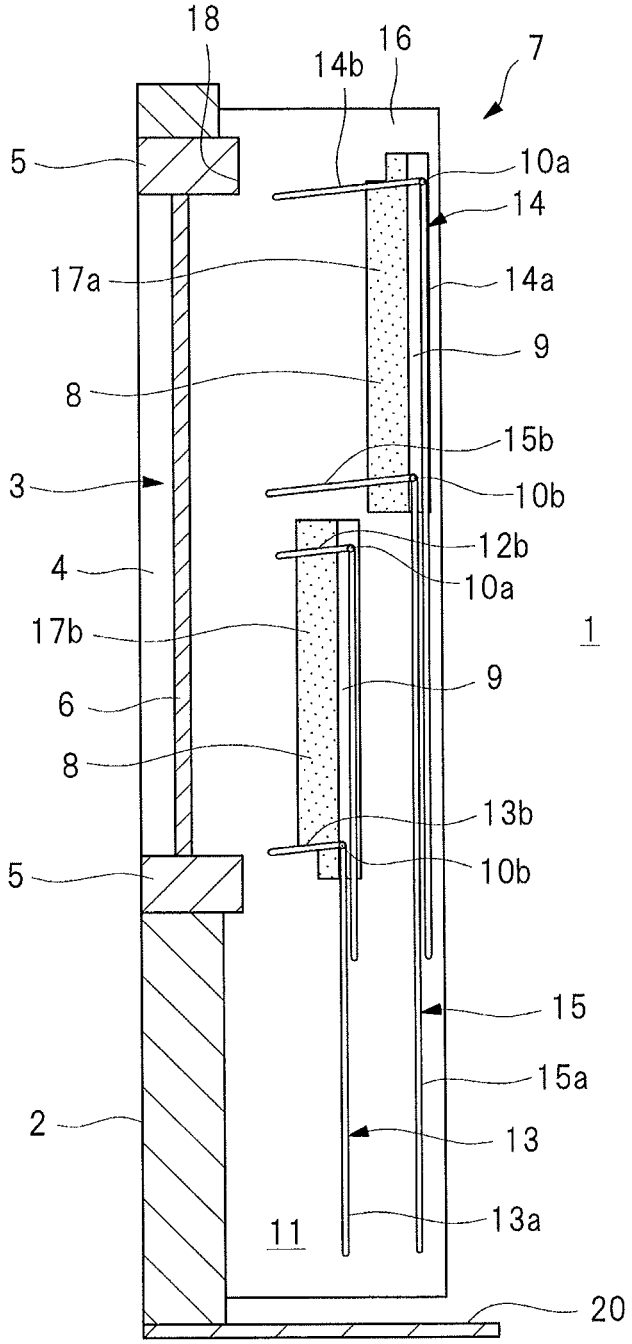
FIG. 4 is a sectional view illustrating a state where a heat insulation shielding member of the window conduction heat shielding apparatus is made to retreat along transverse guide grooves.

The upper and lower support bars 10*a* and 10*b* are disposed laterally symmetrically with respect to a center line (not shown) of a side surface of the fixing base 9 as illustrated in (a) of FIG. 3. Specifically, the upper support bar 10*a* is provided on an indoor surface side which is a right side from the center line, and the lower support bar 10*b* is provided on a front surface side (outdoor side) which is a left side from the center line. In this manner, as illustrated in FIGS. 1, 4 and 5, the upper and lower support bars 10*a* and 10*b* can be guided by the guide grooves 12 to 15 which are respectively independent tracks.

On the both side parts of the window 3 in the indoor of the computer room 1, a pair of right and left base guides 16 and 16 are attached (see FIG. 2), and the guide grooves 12 to 15 to guide the pair of upper and lower support bars 10*a* and 10*b* which project horizontally from both side surfaces of the fixing bases 9 of the upper heat shielding unit 17*a* and the lower heat shielding unit 17*b* are provided (see FIG. 1) on opposed surfaces of the both base guides 16 and 16. The base guide 16 is made of, for example, metal, wood or plastic. Note that, when the base guide 16 is made of a comparatively soft material, the guide grooves 12 to 15 are preferably formed of a member having rigidity, for example, a member made of metal for preventing deformation.

The guide grooves 12 to 15 include an upper guide groove 12 and a lower guide groove 13 for the lower heat shielding unit 17*b* and an upper guide groove 14 and a lower guide groove 15 for the upper heat shielding unit 17*a*. The upper guide groove 12 for the lower heat shielding unit 17*b* is made up of a longitudinal groove 12*a* in a vertical direction and a transverse groove 12*b* in an indoor-to-outdoor direction which is continuous and bent from an upper end of the longitudinal groove 12*a* toward the window frame 5. The lower guide groove 13 for the lower heat shielding unit 17*b* is made up of a longitudinal groove 13*a* in a vertical direction and a transverse groove 13*b* in an indoor-to-outdoor direction which is continuous and bent from an upper end of the longitudinal groove 13*a* toward the window frame 5.

The upper guide groove 14 for the upper heat shielding unit 17*a* is made up of a longitudinal groove 14*a* in a vertical direction and a transverse groove 14*b* in an indoor-to-outdoor direction which is continuous and bent from an upper end of the longitudinal groove 14*a* toward the window frame 5. The lower guide groove 15 for the upper heat shielding unit 17*a* is made up of a longitudinal groove 15*a* in a vertical direction and a transverse groove 15*b* in an indoor-to-outdoor direction which is continuous and bent from an upper end of the longitudinal groove 15*a* toward the window frame 5.

For the purpose of restricting the movement of the support bars 10*a* and 10*b* within a prescribed range, the lower ends of the longitudinal grooves 13*a*, 14*a* and 15*a* and the tip ends of the transverse grooves 13*b*, 14*b* and 15*b* are closed. In addition, in order to prevent the upper heat shielding unit 17*a* and the lower heat shielding unit 17*b* from interfering with each other during the movement, the guide grooves 14 and 15 for the upper heat shielding unit 17*a* are disposed at predetermined distance on an outer side of the guide grooves 12 and 13 for the lower heat shielding unit 17*b*, and a length of the guide grooves 14 and 15 for the upper heat shielding unit 17*a* is made to be about twice as long as a length of the guide grooves 12 and 13 for the lower heat shielding unit 17*b*.

In order to prevent the upper heat shielding unit 17*a* and the lower heat shielding unit 17*b* from moving in the direction departing from the window due to the vibration of an earthquake and others, the transverse grooves 12*b*, 13*b*, 14*b* and 15*b* are preferably formed so as to be downwardly inclined from the indoor side toward the outdoor side.

Figure 6:
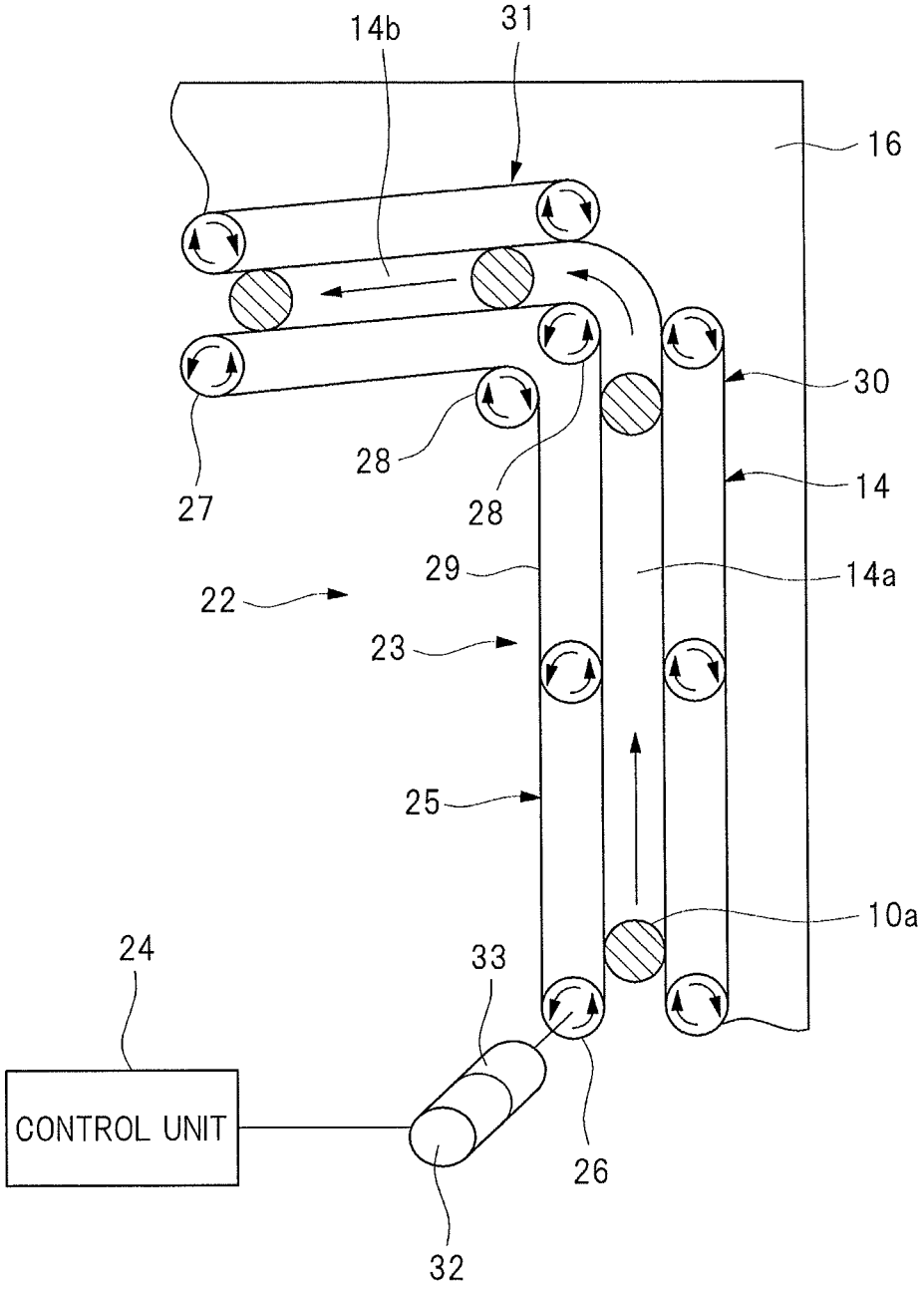
FIG. 6 is a diagram schematically illustrating a configuration of an adjustment mechanism.
Figure 7:
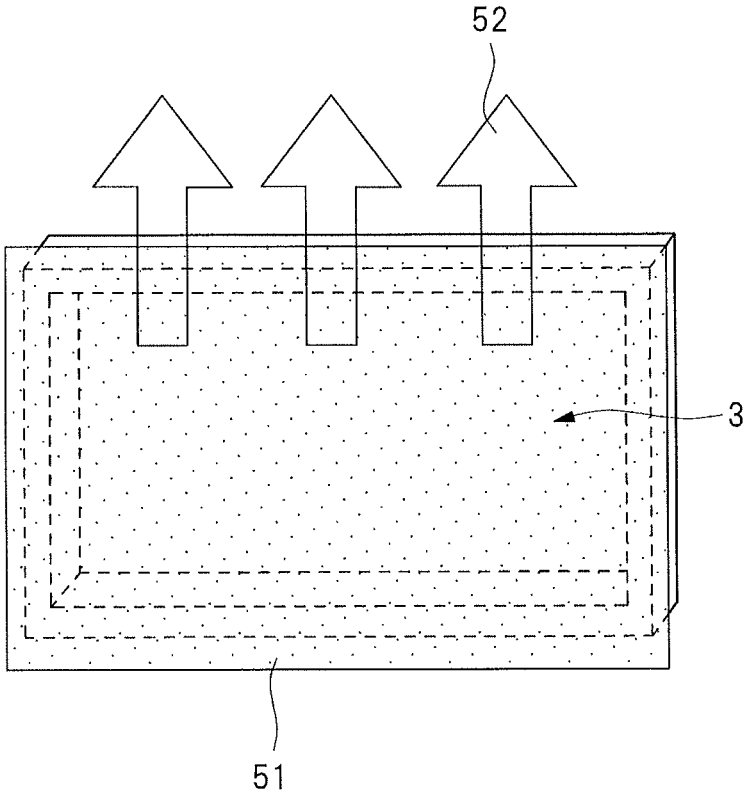
FIG. 7 is a perspective view illustrating a case where a shading curtain which is a conventional technique is provided.

In the heat insulating material fixing base guide 16, as illustrated in FIG. 6, an adjustment mechanism 22 which adjusts a descending speed so as to be slowed down when the guiding support bars 10*a* are moved along the guide grooves 14 and the upper heat shielding unit 17*a* and the lower heat shielding unit 17*b* are made to descend from the window frame 5 to the storage part 11 is preferably provided for the improvement of durability and safety of the window conduction heat shielding apparatus 7. In addition, in that case, the adjustment mechanism 22 preferably has a movement mechanism 23 to move the upper heat shielding unit 17*a* or the lower heat shielding unit 17*b* from the storage part 11 to the window frame 5 or from the window frame 5 to the storage part 11 and a control unit 24 to control the movement mechanism 23 for achieving the automation.

The movement mechanism 23 is made up of a driving belt conveyer 25 disposed along the guide groove 14 on one side surface (left side in FIG. 6, that is, window side) of the guide groove 14 and driven belt conveyers 30 and 31 for the longitudinal direction and horizontal direction which are auxiliary guides disposed along the guide groove 14 on the other side surface (right side in FIG. 6) of the guide groove 14 so as to sandwich the guide groove 14 with the driving belt conveyer 25. This driving belt conveyer 25 is provided with: a driving wheel 26 disposed at a lower part of one side surface of the longitudinal groove 14*a* of the guide groove 14; a driven wheel 27 disposed at the tip end of the transverse groove 14*b*; a corner auxiliary wheel 28 disposed on an inner side of a corner part where the longitudinal groove 14*a* and the transverse groove 14*b* intersect with each other; and an endless belt 29 looped over the driving wheel 26, the driven wheel 27 and the corner auxiliary wheel 28. The driven belt conveyers 30 and 31 are not provided with driving means. A longitudinal guide and a transverse guide may be used in place of the driven belt conveyers 30 and 31.

A motor 32 is connected to the driving wheel 26 of the driving belt conveyer 25 via a deceleration mechanism 33. The motor 32 of the driving belt conveyer 25 is constituted so as to be controlled by the control unit 24. In the control unit 24, a switching circuit for opening or closing the window conduction heat shielding apparatus 7 is incorporated. Thus, by the switch operation for the control unit 24, the upper heat shielding unit 17*a* and the lower heat shielding unit 17*b* can be automatically attached to the window frame 5, and conversely detached automatically from the window frame 5 to store them in the storage part 11.

Next, an operation of the window conduction heat shielding apparatus having the above-described configuration will be described. When the window conduction heat shielding apparatus 7 is operated by the switch operation, the motor 32 is driven by the control unit 24 as illustrated in FIG. 6, and the belt conveyer 25 is driven via the deceleration mechanism 33 and the driving wheel 26. By this belt conveyer 25 being driven, the upper heat shielding unit 17*a* and the lower heat shielding unit 17*b* which are stored in the storage part 11 below the window as illustrated in FIG. 5 are first lifted vertically along the longitudinal grooves 12*a* to 15*a* of the guide grooves 12 to 15 as illustrated in FIG. 4, are then moved in parallel almost horizontally to the window 3 along the transverse grooves 12*b* to 15*b*, and are attached to the indoor side of the window frame 5 as illustrated in FIG. 1.

In this case, when the upper heat shielding unit 17*a* and the lower heat shielding unit 17*b* are moved at the same speed, since the lower heat shielding unit 17*b* is shorter than the upper heat shielding unit 17*a* in a length of the guide grooves 12 to 15, the lower heat shielding unit 17*b* is first attached to a position in the lower half of the window 3, and the upper heat shielding unit 17*a* is then attached to a position in the upper half of the window 3.

In this way, since the lower heat shielding unit 17*b* is first attached to the window 3 and the upper heat shielding unit 17*a* is then attached, the upper heat shielding unit 17*a* and the lower heat shielding unit 17*b* can be smoothly attached to the window 3 without interference with each other. Also, since the indoor side of the window 3 of the computer room 1 is covered in this way with the window conduction heat shielding apparatus 7 made up of the upper heat shielding unit 17*a* and the lower heat shielding unit 17*b*, the heat conducted from the outdoors can be shielded in the window 3 of the computer room 1 in the summer season.

In this case, since the recess part 18 for making the heat insulating material 8 bite into the window frame 5 is provided in the peripheral edge part of the heat insulating material 8 of the upper heat shielding unit 17*a* and the lower heat shielding unit 17*b*, heat conducted from the outdoors can be shielded without the displacement between the heat insulating material 8 and the window frame 5 or the occurrence of a gap due to a vibration of an earthquake and others. Note that an inclination for eliminating the displacement is preferably provided in the recess part 18.

On the other hand, in a case where the upper heat shielding unit and the lower heat shielding unit of the window conduction heat shielding apparatus 7 which are attached to the window are detached from the window and stored (housed), when the window conduction heat shielding apparatus 7 is operated in a reverse direction by a switch operation, the motor 32 is driven in a reverse direction by the control unit 24 in FIG. 6, and the belt conveyer 25 is driven in a reverse direction via the deceleration mechanism 33 and the driving wheel 26. By this belt conveyer 25 being driven, the upper heat shielding unit 17*a* and the lower heat shielding unit 17*b* which are attached to the window 3 as illustrated in FIG. 1 are first moved toward the indoor side almost horizontally along the transverse grooves 12*b* to 15*b* of the guide grooves 12 to 15 as illustrated in FIG. 4, and are then moved in parallel vertically to the storage part 11 below the window along the longitudinal grooves 12*a* to 15*a* and stored in the storage part 11 as illustrated in FIG. 5.

In this way, heat can be efficiently conducted to the outdoors in the winter season, and a load of air conditioning can be reduced. Since the motor 32 is connected via the deceleration mechanism 33 to the driving wheel 26 of the belt conveyer 25, a descending speed at the time of storing the upper heat shielding unit 17*a* and the lower heat shielding unit 17*b* can be suppressed in the same way as an engine brake. In addition, since the upper heat shielding unit 17*a* and the lower heat shielding unit 17*b* which are attached to the window 3 can be moved promptly and easily to the storage part 11 below the window in this way, checking and cleaning of the window 3 can be performed easily.

It is needless to say that the present invention is not limited to the above-mentioned embodiments and various modifications can be made within the scope of the present invention. For example, the endless belt 29 of the belt conveyer 25 preferably has surface irregularities for the purpose of suppressing slipping of the support bars 10*a* and 10*b*.

In a case where not only a data canter but a computer room of a company has a window, the apparatus can be applied regardless of maker and specifications of a window and can be installed afterward to an existing window. In addition, an energy saving effect using conduction heat can be expected by automatically controlling the conduction heat of the window.

While the present invention has been illustrated and described with respect to a particular embodiment thereof, it should be appreciated by those of ordinary skill in the art that various modifications to this invention may be made without departing from the spirit and scope of the present.

What is claimed is:

1. A window conduction heat shielding apparatus that shields heat conducted from an outdoor surface to an indoor surface of a window of a computer room, the apparatus comprising:

a heat shielding unit that has a heat insulating material formed according to a size of the window and a fixing base provided on an indoor surface of the heat insulating material;

support bars provided in both side parts of the fixing base; and base guides that are provided in both side parts of the window and have guide grooves to guide the heat shielding unit via the support bars from a storage part below the window to the indoor surface of the window or from the indoor surface of the window to the storage part, wherein at least one base guide has an adjustment mechanism to adjust a moving speed when the heat insulating material is moved from the indoor surface of the window to the storage part via the support bars along the guide grooves.

2. The window conduction heat shielding apparatus according to claim 1, wherein the heat shielding unit is stored in the storage part while maintaining a posture in which the heat shielding unit is attached to the indoor surface of the window.

3. The window conduction heat shielding apparatus according to claim 1, wherein the heat shielding unit is divided into a plurality of sections according to a height of the storage part.

4. The window conduction heat shielding apparatus according to claim 1, wherein the adjustment mechanism includes a movement mechanism to move the heat shielding unit from the storage part to the indoor surface of the window or from the indoor surface of the window to the storage part and a control unit to control a moving direction and a moving speed of the movement mechanism.

5. The window conduction heat shielding apparatus according to claim 1, wherein each base guide has an adjustment mechanism to adjust a moving speed when the heat insulating material is moved from the indoor surface of the window to the storage part by way of the support bars along the guide grooves.

* * * * *